US007748602B2

(12) United States Patent
Bethke et al.

(10) Patent No.: US 7,748,602 B2
(45) Date of Patent: Jul. 6, 2010

(54) FORMS CONTAINING REMOVABLE HANG TAGS AND METHODS OF PRODUCING THE SAME

(75) Inventors: Darvin R. Bethke, Forest Lake, MN (US); David R. Emmert, Angola, IN (US); James L. Warmus, LaGrange, IL (US)

(73) Assignee: Moore Wallace North America, Inc., Stamford, CT (US)

( * ) Notice: Subject to any disclaimer, the term of this patent is extended or adjusted under 35 U.S.C. 154(b) by 1121 days.

(21) Appl. No.: 11/401,590

(22) Filed: Apr. 11, 2006

(65) Prior Publication Data

US 2007/0235507 A1 Oct. 11, 2007

(51) Int. Cl.
*B65D 15/00* (2006.01)
*B65D 27/00* (2006.01)

(52) U.S. Cl. ..... 229/92.8; 229/92.1

(58) Field of Classification Search ..... 229/92.1, 229/92.3, 92.8, 70, 74
See application file for complete search history.

(56) References Cited

U.S. PATENT DOCUMENTS 4,846,501 A 7/1989 Del Grande
4,940,690 A * 7/1990 Skees ..... 503/206
5,893,512 A 4/1999 Diedrich
6,003,760 A 12/1999 Abercrombie
6,015,085 A 1/2000 Cannon et al.
6,092,843 A * 7/2000 Peterson et al. ..... 283/116
6,948,742 B2 * 9/2005 Buck ..... 283/56
2003/0067159 A1 * 4/2003 Ritchie et al. ..... 283/101
2004/0074128 A1 * 4/2004 Best et al. ..... 40/674
2004/0154195 A1 * 8/2004 Jewell et al. ..... 40/124.01
2005/0252954 A1 * 11/2005 Buck ..... 229/92.1
2006/0117631 A1 * 6/2006 Lewis ..... 40/673

* cited by examiner

*Primary Examiner*—Jes F Pascua
(74) *Attorney, Agent, or Firm*—Hanley, Flight & Zimmerman, LLC

(57) ABSTRACT

Methods and apparatus for a form for a postcard mailer are disclosed. An example form includes a substrate sheet having top and bottom edges, first and second side edges, and first and second faces. The form also includes at least first and second fold lines dividing the sheet into at least first, second, and third panels with a hang tag removably coupled to at least a portion of one of the first, second or third panels. Finally, the form has a first adhesive area provided on the first face of at least one of the second or third panels and a second adhesive area provided on the second face of at least one of the first and second panels, wherein the first and second adhesive areas adhere the third panel to the first face of the second panel and the first panel to the second face of the second panel when the substrate sheet is folded about the fold lines.

15 Claims, 8 Drawing Sheets

FORMS CONTAINING REMOVABLE HANG TAGS AND METHODS OF PRODUCING THE SAME

FIELD OF THE DISCLOSURE

The present disclosure relates generally to forms and, more particularly, to forms having a removable hang tag.

BACKGROUND

In the manufacturing of business forms, it is often desirable to produce a form that contains a hang tag that can be removed and suspended from another surface. For example, the Department of Motor Vehicles for a state may need a mailable form that contains a disabled or handicap parking permit, which can be removed from the form and suspended from a recipient's rear view mirror in his automobile.

Typically, hang tag forms are separately manufactured and mailed to a recipient in an envelope such as, for example a No. 10 envelope, along with an informational or instructional letter from the sender. Mailing an envelope filled with a hang tag and an instructional letter increases the weight of the mailing, which increases the costs associated with mailing the package, as compared to mailing a postcard or an integrated form. Indeed, postal rates for first class mailing differ substantially between letters and postcards. For non-automation mailings, the difference in rates between a regular-size envelope and a regular-size postcard is $0.15.

In addition, hang tags are typically laminated to increase the durability of the hang tag and prolong its useful life. Typical laminates used to protect hang tags include a certain percentage of silicon. However, a silicon-based laminate is unable to support printing, such as laser printing, on the top of the laminated surface. Consequently, with some known laminated tags, any information or images have to be included or applied prior to the lamination process.

DETAILED DESCRIPTION

Figure 1:
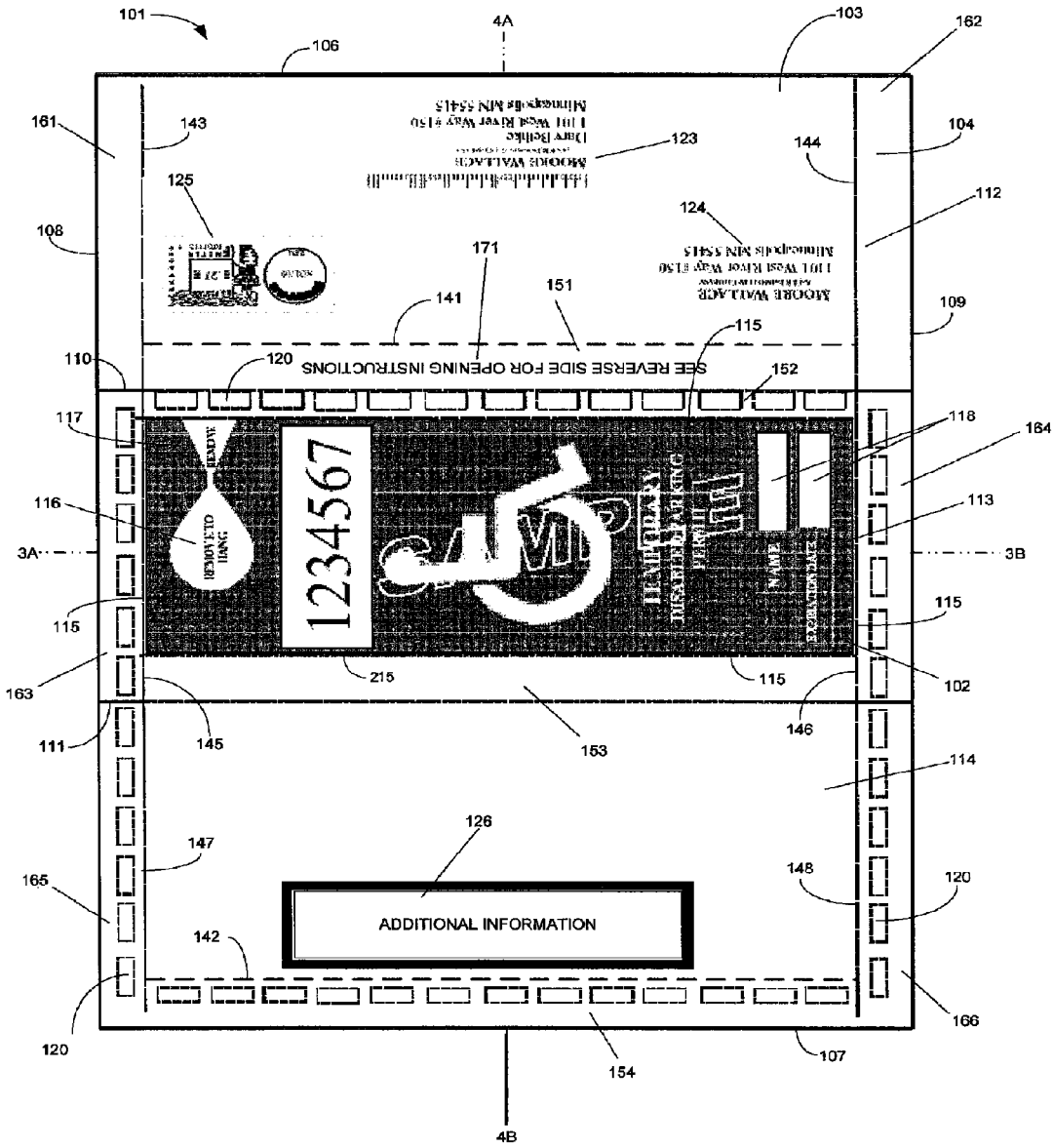
FIG. 1 is a plan view of a front surface of an example form having a removable hang tag.
Figure 2:
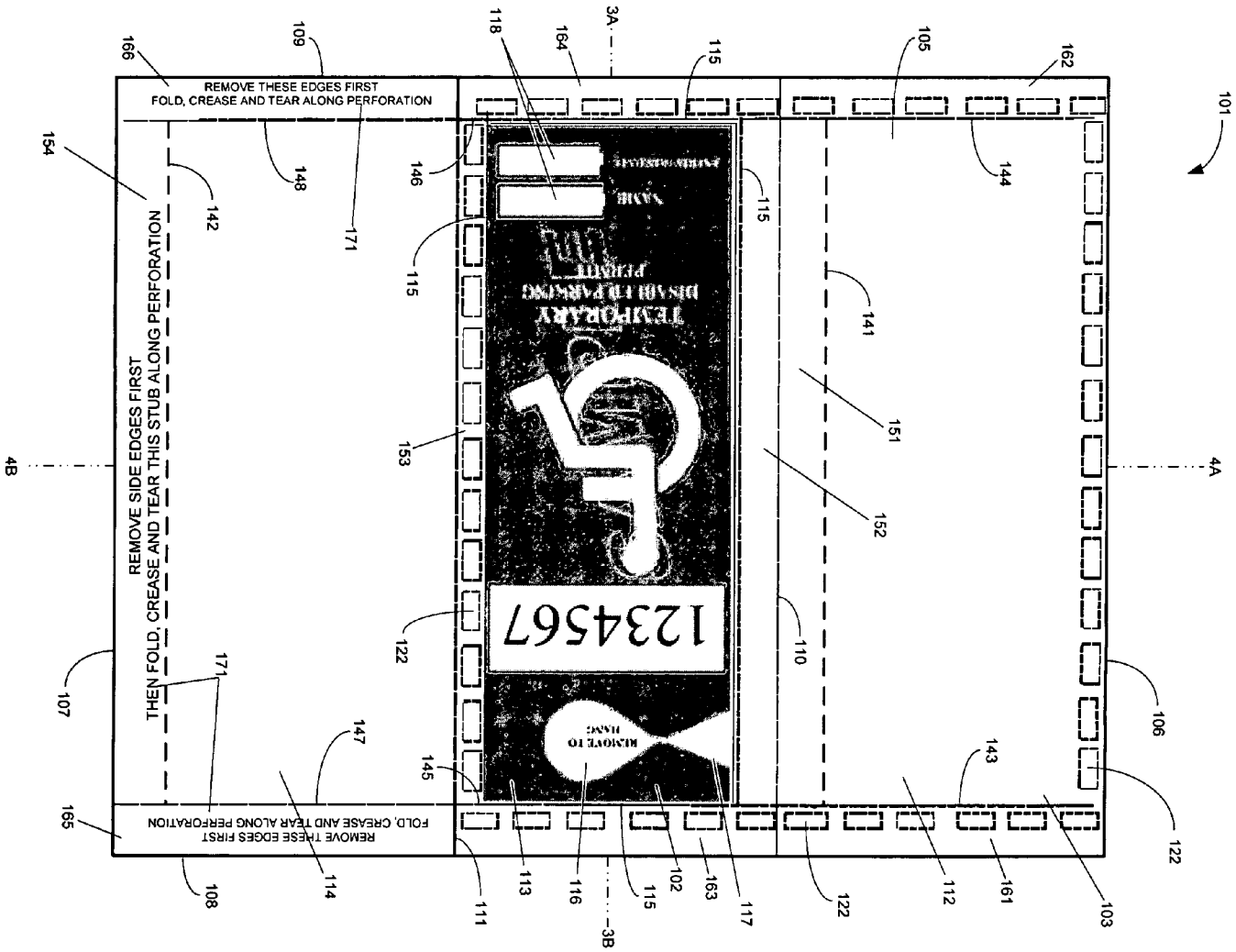
FIG. 2 is a plan view of a back surface of the example form of FIG. 1.
Figure 3:
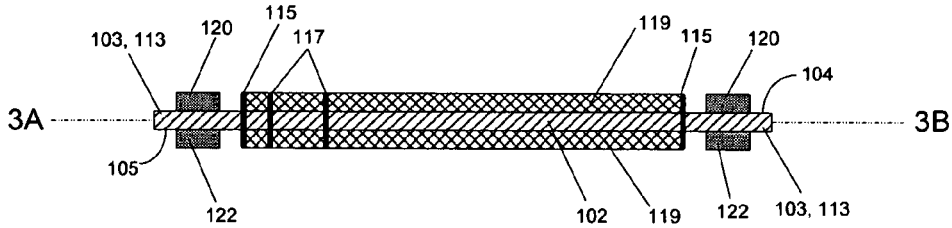
FIG. 3 is a cross-sectional view of the example form of FIG. 1 taken along the 3A-3B axis.
Figure 4:
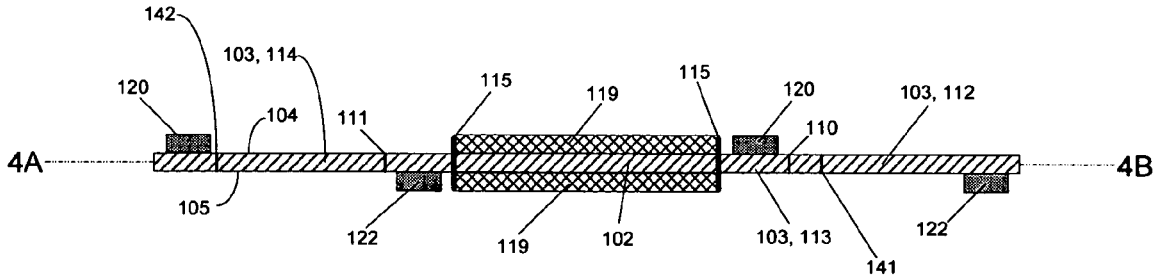
FIG. 4 is a cross-sectional view of the example form of FIG. 1 taken along the 4A-4B axis.

An example form 101 having a removable hang tag 102 is illustrated in FIGS. 1-6. As shown in FIGS. 1-2, the example form 101 has a substrate sheet 103 with a first side or face 104 and a second side or face 105. The substrate sheet 103 may be, for example, card stock. The substrate sheet 103 may be a substantially opaque paper having parallel top and bottom edges 106, 107 and substantially parallel first and second side edges 108, 109. The side edges 108, 109 are perpendicular to the top edge 106 and the bottom edge 107. The substrate sheet 103 further includes first and second fold lines 110, 111 parallel to the top and bottom edges 106, 107 for dividing the substrate sheet 103 into three panels 112, 113, 114. According to the example, the panels 112, 113, 114 may be approximately or substantially the same size. Also, according to the example, the first panel 112 is the top panel of the form 101, the second panel 113 is the second or middle panel of the form 101, and the third panel 114 is the bottom panel of the form 101.

In the example form 101, the removable hang tag 102 is disposed on the second panel 113. The removable hang tag 102 in the example shown in FIGS. 1 and 2 is a temporary disabled parking permit, though the hang tag 102 can be any other type of hang tag and, thus, may contain any other desired information. Further, the hang tag 102 may be made of a paper fiber product or a synthetic material such as, for example, vinyl.

The hang tag 102 of the second panel 113 is removably coupled to the outer periphery of the second panel 113 by lines of weakness 115. The lines of weakness 115 may be any line of weakness, such as perforated lines, die-cut lines, and/or folds. Alternatively, the lines of weakness 115 may be outlines 215 that the recipient can cut with scissors or any other cutting instrument. Furthermore, the lines of weakness 115 may coincide with fold lines 110, 111 so that the hang tag 102 composes substantially the entirety of the second panel 113.

The hang tag 102 includes a removable portion 116 that may be removed to create an opening. Once the removable portion 116 has been removed, the hang tag 102 may be suspended from a surface such as, for example, an interior rear view mirror of a vehicle, by slipping a portion of the rear view mirror through the opening or hole created by the removal of the removable portion 116. The removable portion 116 is coupled to the hang tag 102 via perforations or die-cut lines 117. In alternative examples, the perforations 117 can be any type of lines of weakness or outlines as described above in connection with lines of weakness 115. In some examples, the removable portion 116 may be removed before the form 101 is folded and mailed to the recipient.

The hang tag 102 further includes informational areas 118 on the first and second faces 104, 105. The informational areas 118 can be used to display information such as, for example, the recipient's name or other identifying information, an expiration date, and/or any other relevant data.

The hang tag 102 is coated with a laminate layer 119 on the front and back faces 104, 105. See FIGS. 3 and 4, noting that the relative dimensions shown in the Figures are not to scale, and portions have been enlarged for clarity. The laminate layer 119 may include a non-silicon based laminate, which can accept printing over the top surface of the laminate layer 119 without bleeding, feathering, smearing, rubbing off or otherwise becoming illegible or of poor quality. In the illustrated example, the laminate layer 119 may be, for example, 0.5 millimeters thick. In other examples, the hang tag 102 and/or additional information in the information areas 118 may be printed before the laminate layer 119 is applied, after the laminate layer 119 is applied, or any combination thereof.

Also, in the illustrated example, the laminate layer 119 coincides with the dimensions of the hang tag 102. However, the laminate layer 119 may alternatively extend over the full dimensions of the second panel 113. In addition, the lines of weakness 115, 117 extend through the laminate layer 119.

The first face 104 of the substrate 103 includes a first adhesive pattern 120. In the illustrated example of FIGS. 1-4, the first adhesive pattern 120 is provided along at least some of the edges, i.e. adjacent to the periphery, of the panels 113 and 114 for holding the first face 104 of the third panel 114 against the first face 104 of the second panel 113 when the form is folded about the fold line 111. In the illustrated example, the first adhesive pattern 120 includes spaced rectangles of adhesive. However, any other configuration of adhesive may be applied including dots, spots, or a continuous line or strip of adhesive. In addition, the first adhesive pattern 120 may be applied in any other pattern and/or locations on the first face 104 of either or both of the second and/or third panels 113, 114.

Similarly, the second face 105 of the substrate 103 includes a second adhesive pattern 122. In the illustrated example of FIGS. 1-4, the second adhesive pattern 120 is provided along at least some of the edges, i.e. adjacent to the periphery, of the panels 112 and 113 for holding the second face 105 of the first panel 112 against the second face 105 of the second panel 113 when the form is folded about the fold line 110. In the illustrated example, the second adhesive pattern 122 includes spaced rectangles of adhesive. However, any other configuration of adhesive may be applied including dots, spots, or a continuous line or strip of adhesive. In addition, the second adhesive pattern 122 may be applied in any other pattern and/or location on the second face 105 of either or both of the first and/or second panels 112, 113.

Furthermore, the adhesive used in the first or second adhesive patterns 120, 122 may be a pressure activated adhesive or any other type of adhesive that can be used to create a removable bond. The use and configuration of the adhesive patterns 120, 122 may be guided by the standards set forth in the United States Postal Service Domestic Mail Manual. As an alternative, the adhesive patterns 120, 122 may be substituted with tabs or spots (not shown) of adhesive in the corners of the panels 112, 113, 114, which would releasably hold the panels together in a postcard formation when the form 101 is Z-folded about the fold lines 110, 111.

The form 101 also includes an outgoing address area 123 on the first face 104 of the first panel 112. The first face 104 of the first panel 112 also includes a return address area 124 and a postage area 125 for the placement of the appropriate postage to mail a folded form 101. In addition, the third panel 114 includes an area 126 that can be used to display additional information to the recipient of the hang tag 102.

The form 101 includes a plurality of additional lines of weakness 141, 142, 143, 144, 145, 146, 147, 148. The first panel 112 includes a line of weakness 143 adjacent to the side 108 to form a removable strip 161. The first panel 112 also includes a line of weakness 144 adjacent to the side 109 to form a removable strip 162. Finally, the first panel 112 includes a line of weakness 141 adjacent to the fold line 110 that extends between the lines of weakness 143, 144 and defines a removable strip 151 which, in the example illustrated in FIG. 1, includes opening instructions 171.

The second panel 113 includes a line of weakness 145 adjacent to the side 108 to form a removable strip 163. The second panel 113 also includes a line of weakness 146 adjacent to the side 109 to form a removable strip 164. The lines of weakness 145, 146 may coincide with the lines of weakness 115. In addition, the lines of weakness 115, 110, 145, 146 form a strip 152 near the top of the second panel 113, and the lines of weakness 115, 111, 145, 146 form a strip 153 adjacent to the bottom of the second panel 113.

The third panel 114 includes a line of weakness 147 adjacent to the side 108 to form a removable strip 165. The third panel 114 also includes a line of weakness 148 adjacent to the side 109 to form a removable strip 166. Finally, the third panel 114 includes a line of weakness 142 adjacent to the bottom side 107 that extends between the lines of weakness 147, 148 and defines a removable strip 154. As shown in FIG. 2, the strips 154, 165, 166 may also include the opening instructions 171.

The lines of weakness 141, 142, 143, 144, 145, 146, 147, 148 may be die cuts, perforations or any other type of weakness and, as described below, are intended to enable the disassociation of the strips 151, 152, 154, 161, 162, 163, 164, 165 from the form 101, as described below.

Figure 5:
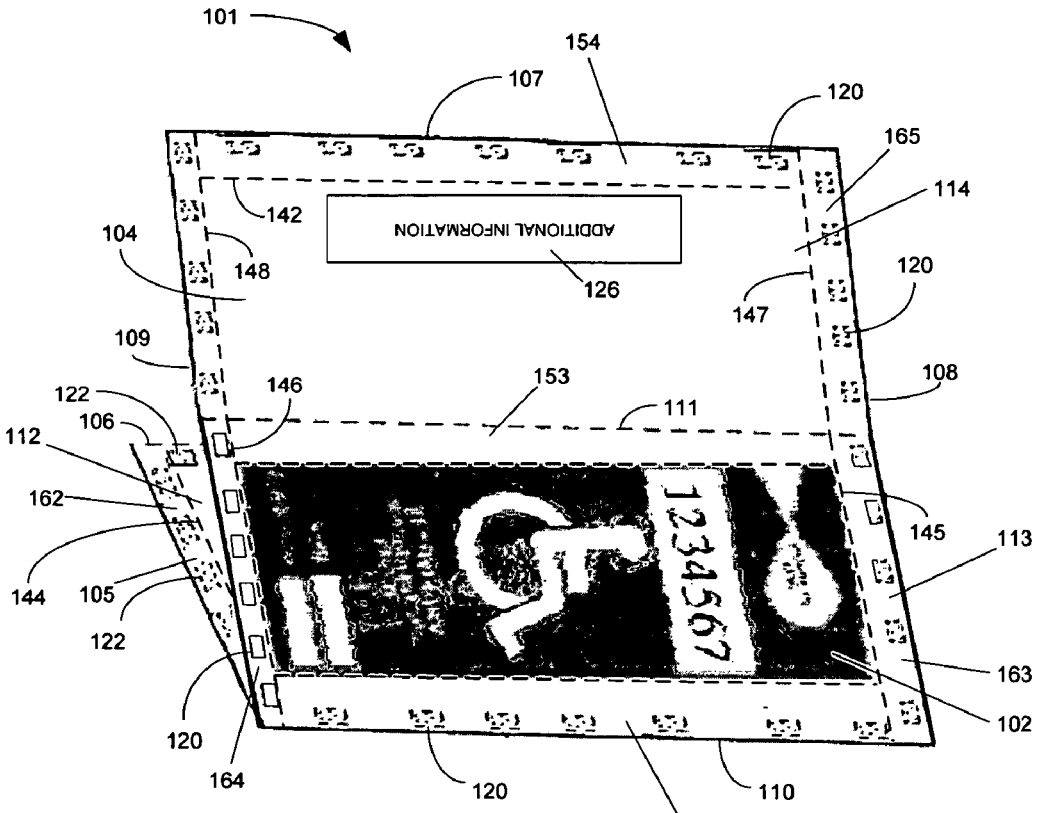
FIG. 5 is a perspective view showing the example form of FIG. 1 being folded into a mailpiece.

FIG. 5 illustrates the example form 101 being Z-folded into a mailer. The form 101 is oriented in FIG. 5 like the form 101 in FIG. 1 but upside-down and folded along the fold line 110 so the back face 105 of the first panel 112 opposes the back face 105 of the second panel 113. Pressure is then applied to the first and second panels 112, 113 so that the second adhesive pattern 122 activates a bond to permanently or removably join the first and second panels 112, 113. The form 101 is then folded about the fold line 111 so that the front face 104 of the third panel 114 opposes the front face 105 of the second panel 113. Pressure is then applied to the folded form 101 to activate the first adhesive pattern 120 to permanently or removably join the second and third panels 113, 114.

As the first and second panels 112, 113 are joined, the strip 153 is adhered to the back face 105 of the first panel 112 near the top edge 106. The strips 151, 152 oppose each other and may be joined to form a portion of a third removable tab 181. In addition, the removable strips 162 and 164 are joined to form a portion of a second removable tab 183, and the removable strips 161 and 163 are joined to form a portion of a first removable tab 185. When the form 101 is folded along the fold line 111 so that the front face 104 of the third panel 114 opposes the front face 104 of the second panel 113, the removable strip 154 is adhered to the removable strip 152 to complete the third removable tab 181. Furthermore, the removable strip 166 is adhered to the removable strip 164 to complete the second removable tab 183, and the removable strip 165 is adhered to the removable strip 163 to complete the first removable tab 185.

Figure 6:
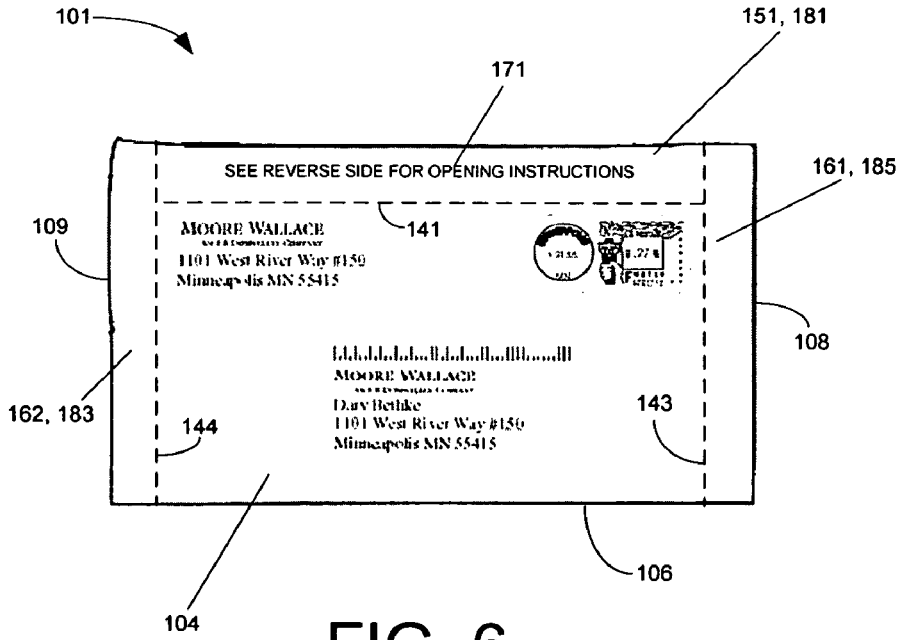
FIG. 6 is a perspective view of the example form of FIG. 1 folded into a mailpiece.

FIG. 6 illustrates the completely folded form 101. To open the form 101, the first removable tab 185 is removed from the form 101 by tearing the first removable tab 185 from the form 101 along the line of weakness 143. Similarly, the second removable tab 183 is then removed from the form 101 by tearing the second removable tab 183 along the line of weakness 144. Next, the third removable tab 181 is removed from the form 101 by tearing the third removable tab 181 along the line of weakness 141. This allows the recipient of the form 101 to access the interior of the form 101 and to remove the hang tag 102 therefrom and suspend the hang tag 102 from a surface or object such as, for example, an interior rear view mirror in a vehicle.

Figure 7:
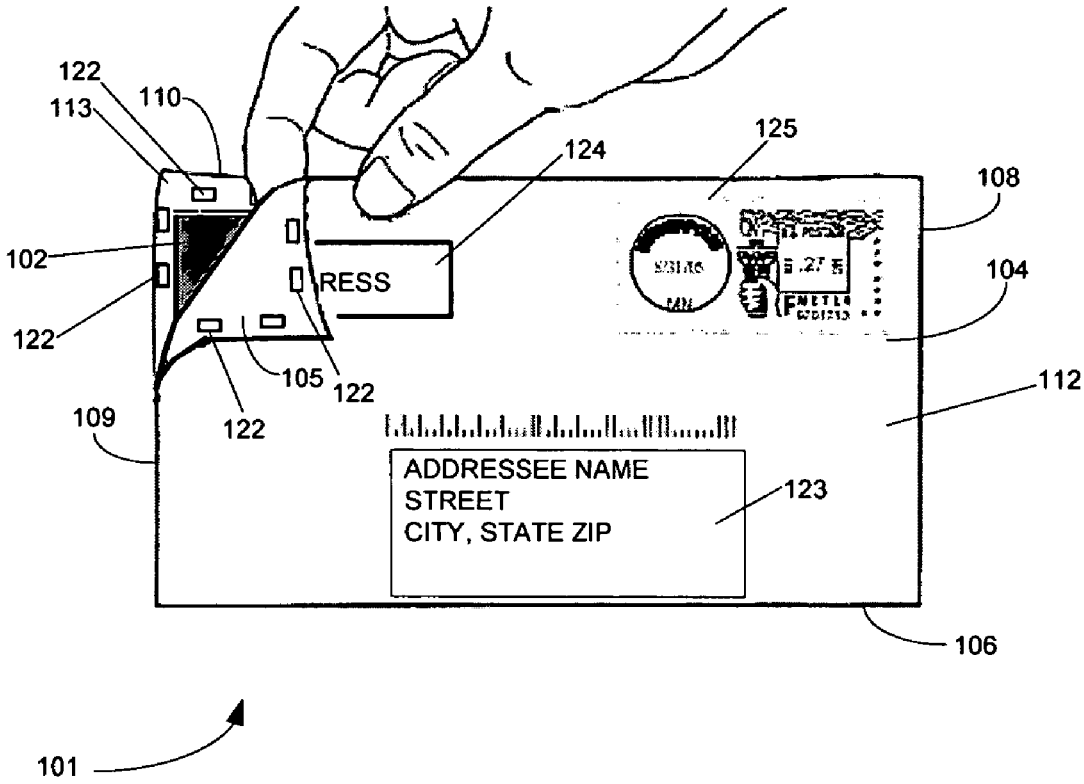
FIG. 7 is a perspective view depicting one manner in which an alternative example mailpiece may be opened.

FIG. 7 illustrates an alternative example where the form 101 may be opened without tearing of edges. To open the form 101 of FIG. 7, the recipient places a finger, letter opener or other instrument between two adjacent panels, i.e., between the first and second panels 112, 113 and between the second and third panels 113, 114. The recipient then uses his finger or other instrument to apply a force to overcome the bonding force of the second adhesive pattern 122 (pictured) and the first adhesive pattern 120 (i.e., the bond between the second and third panels 113, 114).

After the recipient has unfolded the form 101, i.e., broken the bonds created by the first and second adhesive patterns 120, 122, the recipient may then fully view the contents of the form 101 and remove the removable hang tag 102. The hang tag 102 may be removed by the recipient along the lines of weakness 115, and the removable portion 116 may be removed by disassociating the removable portion 116 from the hang tag 102 along the lines of weakness 117. The hang tag 102 may then be suspended from a surface or object such as, for example, an interior rear view mirror in a vehicle.

Figure 8:
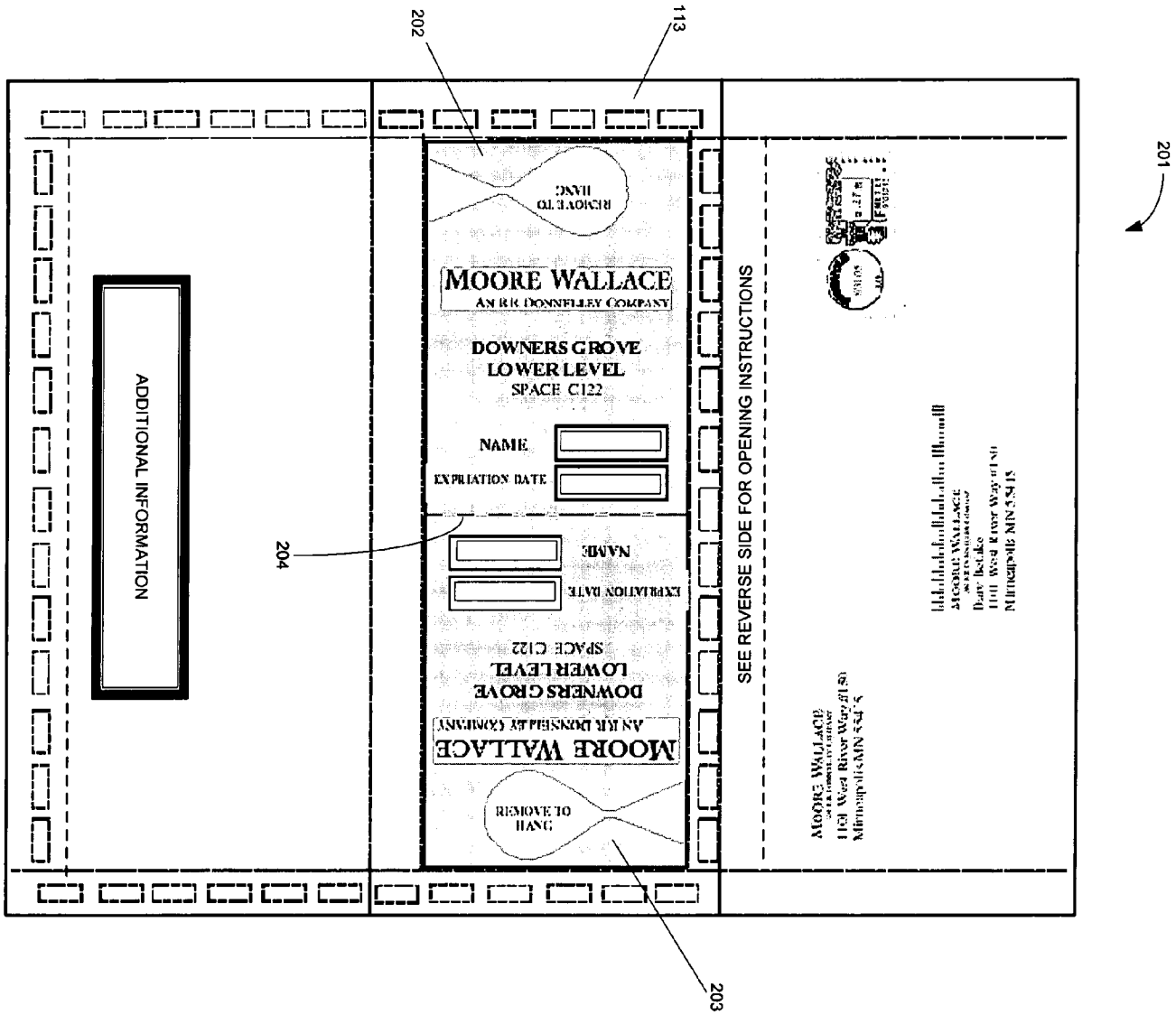
FIG. 8 is a plan view of the front of another example form.
Figure 9:
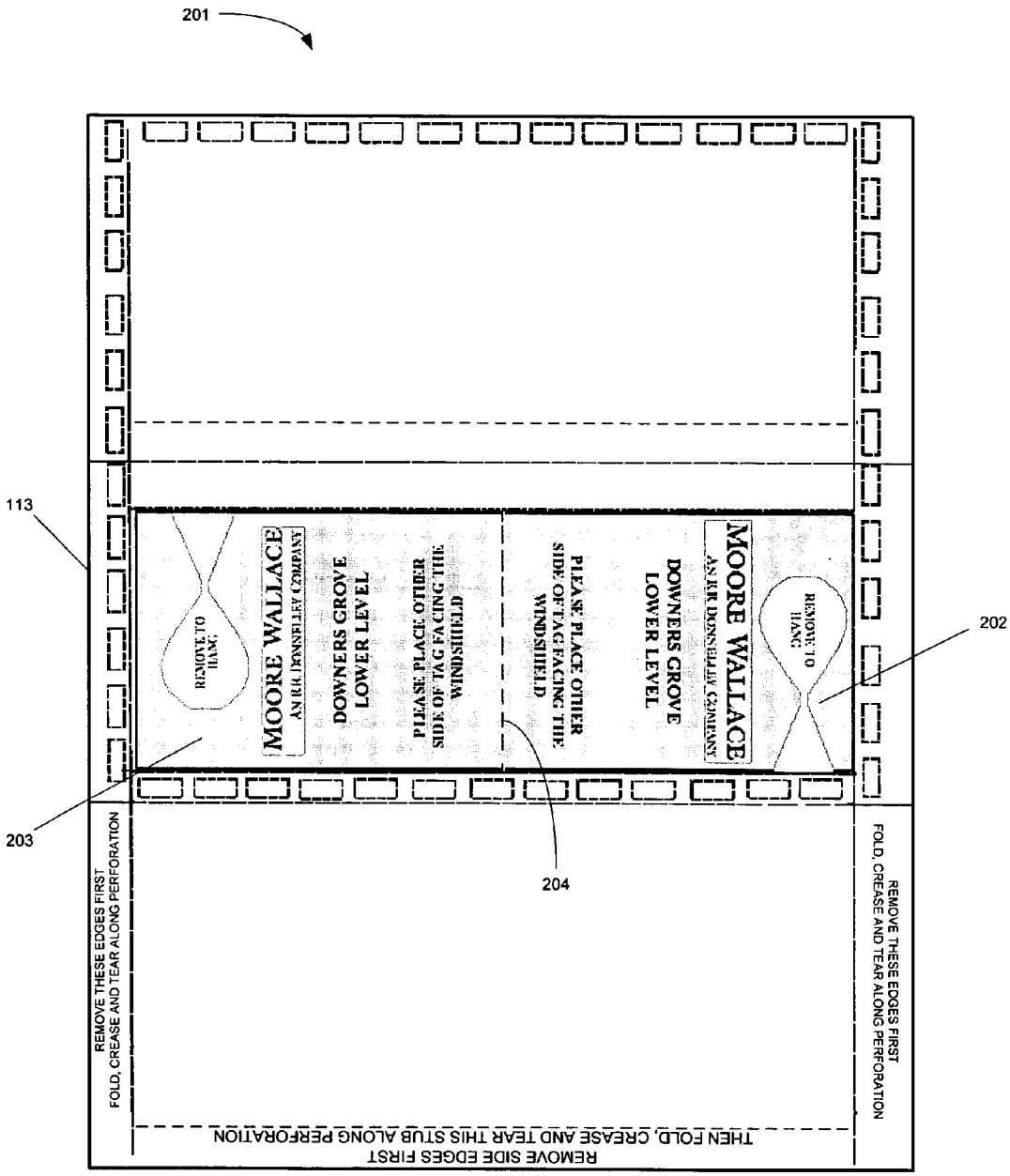
FIG. 9 is a plan view of the back of the example form of FIG. 8.

FIGS. 8 and 9 depict an alternative example form 201 that contains a first hang tag 202 and a second hang tag 203. The second example form 201 contains many of the same elements and components of the first example form 101 and function in a similar manner. In the interest of brevity, a description of those elements or components of the second form 201 and hang tags 202, 203 that are the same as the first example form 101 and hang tag 102, will not be repeated.

The second form 201 illustrates that the two hang tags 202, 203 may be included in the second panel 113. The hang tags 202, 203 have all the same features as the hang tag 102 of the prior example, except the dimensions of the hang tags 202, 203 are smaller and the hang tags 202, 203 are coupled to each other by a line of weakness 204. The line of weakness 204 may be die-cut, perforations, a fold, or an outline indicating to the user where to cut with scissors or other cutting instrument. Either or both of the hang tags 202, 203 are removed from the form 201 in a similar manner as that described above with respect to hang tag 102 and form 101.

Figure 10:
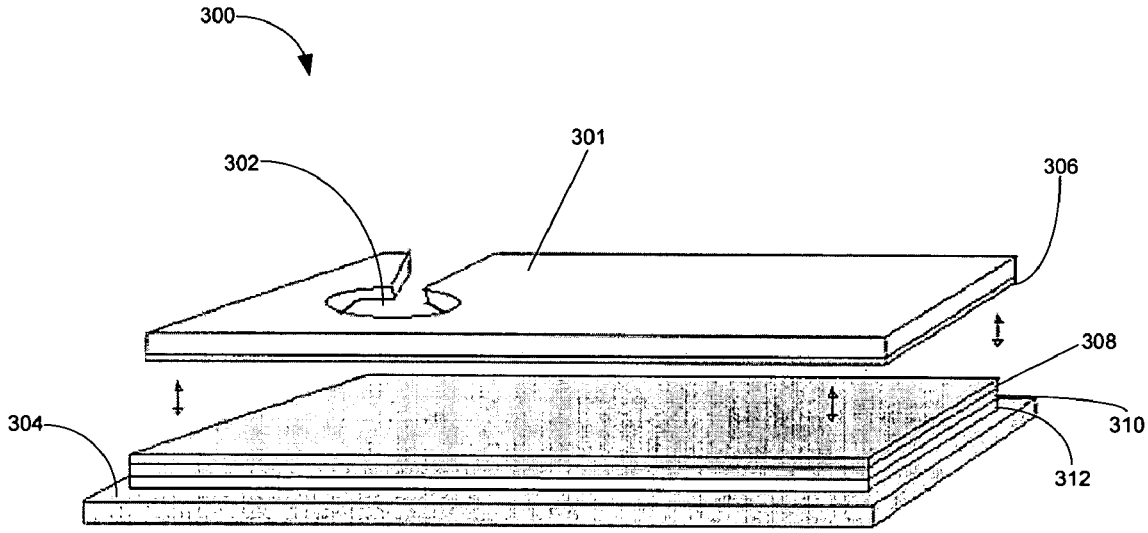
FIG. 10 is a partially exploded view of an alternative example hang tag form.

FIG. 10 shows an alternative construction for an alternative example hang tag form 300. The hang tag form 300 includes a hang tag 301 that may be made of a paper material, a synthetic material, or any other suitable material. The hang tag 301 also has a removable or a removed portion 302 that allows the hang tag 301 to be suspended from a surface or object such as, for example, an interior rear view mirror in a vehicle. The hang tag 301 is adhered to a base substrate 304 via a coupon release technique. This technique involves applying a first layer of cohesive 306 to at least a portion of the back of the hang tag 301, applying a second layer of cohesive to at least a portion the substrate 300, or applying both the first layer of cohesive 306 and the second layer of cohesive 308 to at least a portion of the hang tag 301 and at least a portion of the substrate 304, respectively. The second cohesive layer 308 is attached to the substrate 304 via a thin poly layer 310 of poly material that holds at least a portion of the second layer of cohesive 308 (or first layer of cohesive 306 if the second layer is not present) to at least a portion of the substrate 304. The poly layer 310 is itself adhered to at least a portion of the substrate 304 via an adhesive layer 312. The adhesive layer 312 holds the hang tag 301 to the substrate 304 via a pressure seal or a non-pressure seal assembly. Note that the dimensions of the layers 301, 304, 306, 308, 310, and 312 are not shown to scale, but are enlarged for clarity.

The hang tag form 300 is able to be run through an ink jet printer. The form 300 would be constructed and run through, for example, a flexo press for printing. Then the form 300 may be taken to another piece of equipment to receive a decal. Finally, the form 300 would be finished by for example, incorporating the form 300 into another form, placing the form 300 in an envelope, addressing the form 300, etc.

When the recipient receives the hang tag 301, the recipient can pull the hang tag 301 from the substrate 304 by breaking the releasable bond formed by the first and second cohesive layers 306, 308 and their respective, adjacent layers. Once the bond is broken, the cohesive layers 306, 308 are no longer tacky, i.e., cohesive. Further, once removed, the hang tag 301 can to be suspended from a surface or an object.

Although certain example methods, apparatus, and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A form for a postcard mailer, comprising:

a substrate sheet having top and bottom edges, first and second side edges, and first and second faces;

at least first and second fold lines dividing the sheet into at least first, second, and third panels;

a hang tag removably coupled to at least a portion of one of the first, second or third panels;

a first adhesive area provided on the first face of at least one of the second or third panels; and a second adhesive area provided on the second face of at least one of the first and second panels, wherein the first and second adhesive areas adhere the third panel to the first face of the second panel and the first panel to the second face of the second panel when the substrate sheet is folded about the fold lines, and wherein the hang tag includes lines of weakness forming a portion of the hang tag to be removed to create a hole for suspending the hang tag.

2. A form as defined in claim 1, wherein the lines of weakness include perforations.

3. A form as defined in claim 1, wherein the portion of the hang tag to be removed is to be removed before the form is mailed.

4. A form as defined in claim 1, wherein the hang tag is laminated with a non-silicon based laminate.

5. A form as defined in claim 4, wherein the hang tag further includes printing on the laminate.

6. A form as defined in claim 1, wherein the adhesive patterns comprise at least one of spaced rectangles, spots, dots, or a line.

7. A form as defined in claim 1, wherein the adhesive patterns are disposed adjacent the periphery of the at least one of the first, second or third panels.

8. A form as defined in claim 1, wherein the adhesive areas comprise a pressure sensitive adhesive.

9. A form as defined in claim 1, wherein the adhesive areas are configured to removably adhere the third panel to the first face of the second panel and the first panel to the second face of the second panel.

10. A form as defined in claim 1, further comprising an outgoing address area defined on the first face of the first panel.

11. A form as defined in claim 1, further comprising an area for additional information on the first face of the third panel.

12. A form as defined in claim 1, further comprising another hang tag included in at least a portion of one of the first, second or third panels.

13. A form as defined in claim 1, wherein the hang tag includes the substrate sheet of at least a portion of one of the first, second or third panels;

an adhesive layer applied to at least a portion of a side of the substrate sheet;

a poly layer applied to at least a portion of the adhesive layer; and at least one cohesive layer applied to at least a portion of the poly layer.

14. A form as defined in claim 1, wherein the removable portion is in the form of a circle, a diamond, a triangle, a tear drop or a combination thereof.

15. A form as defined in claim 1, wherein the removable portion includes a slit.

* * * * *